US005899298A

United States Patent [19]

Crouse, Jr.

[11] Patent Number: 5,899,298

[45] Date of Patent: May 4, 1999

[54] SAFETY HARNESS FOR STAIRS

[76] Inventor: Benjamin F. Crouse, Jr., 108 Walnut St., Columbia, Pa. 17512-1113

[21] Appl. No.: 08/820,992

[22] Filed: Mar. 19, 1997

[51] Int. Cl.[6] ..... A62B 1/10

[52] U.S. Cl. ..... 182/234; 182/232

[58] Field of Search ..... 182/3, 4, 5, 8, 182/10, 73, 76, 231, 232, 234, 236, 237, 239, 241; 242/383.2, 383.4

[56] References Cited

U.S. PATENT DOCUMENTS

| | | | |
|---|---|---|---|
| 4,253,287 | 3/1981 | Overmoe | 182/3 X |
| 4,256,098 | 3/1981 | Swan et al. | 128/133 |
| 4,359,139 | 11/1982 | Bloder | 182/234 |
| 4,511,123 | 4/1985 | Ostrobrod | 182/234 X |
| 4,556,123 | 12/1985 | Hargest, III | 182/10 X |
| 4,564,154 | 1/1986 | Takada | 242/383.4 |
| 4,589,523 | 5/1986 | Olson et al. | 182/234 |
| 4,593,787 | 6/1986 | Lew et al. | 182/3 |
| 4,611,688 | 9/1986 | Sekhar | 182/232 X |
| 4,949,812 | 8/1990 | Arthur et al. | 182/239 X |
| 5,167,297 | 12/1992 | Stevenson | 182/3 |
| 5,217,084 | 6/1993 | Olson et al. | 182/234 |
| 5,351,908 | 10/1994 | Umezawa et al. | 242/383.4 |
| 5,390,873 | 2/1995 | Fujimura et al. | 242/383.2 |
| 5,485,971 | 1/1996 | Nakaya et al. | 242/383.4 X |
| 5,522,472 | 6/1996 | Shuman, Jr. et al. | 182/3 |
| 5,524,833 | 6/1996 | Modinger et al. | 242/383.4 X |
| 5,539,945 | 7/1996 | Rosenberg et al. | 182/237 X |
| 5,593,105 | 1/1997 | Schmid et al. | 242/383.4 |

*Primary Examiner*—Daniel P. Stodola
*Assistant Examiner*—Richard M. Smith

[57] ABSTRACT

A safety harness for stairs including a safety belt having a first end portion adapted for adjustable coupling with a torso of a wearer. A second end portion of the safety belt is retractably coupled to a ceiling area at a top of a flight of stairs. An intermediate portion of the safety belt is secured to a wall area adjacent to the flight of stairs. The safety belt will lock when suddenly tugged on to prevent the wearer from falling.

1 Claim, 3 Drawing Sheets

SAFETY HARNESS FOR STAIRS

BACKGROUND OF THE INVENTION

1. Field of the Invention

The present invention relates to a safety harness for stairs and more particularly pertains to preventing a person from falling down a flight of stairs with a safety harness for stairs.

2. Description of the Prior Art

The use of fall preventing devices is known in the prior art. More specifically, fall preventing devices heretofore devised and utilized for the purpose of preventing dangerous falls are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,167,297 to Stevenson discloses a stairway safety and belt attachment.

U.S. Pat. No. 5,219,039 to Bell discloses a fall prevention system for billboards.

U.S. Pat. No. Des. 309,359 to Joachim discloses a child safety harness.

U.S. Pat. No. 4,709,782 to Lipinski discloses a skid-out highrise fire escape device U.S. Pat. No. 4,334,595 to Koch discloses fall preventing devices.

U.S. Pat. No. 5,397,171 to Leach discloses a gait assistance harness apparatus.

While these devices fulfill their respective, particular objective and requirements, the aforementioned patents do not describe a safety harness for stairs for preventing a person from falling down a flight of stairs.

In this respect, the safety harness for stairs according to the present invention substantially departs from the conventional concepts and designs of the prior art, and in doing so provides an apparatus primarily developed for the purpose of preventing a person from falling down a flight of stairs.

Therefore, it can be appreciated that there exists a continuing need for new and improved safety harness for stairs which can be used for preventing a person from falling down a flight of stairs In this regard, the present invention substantially fulfills this need.

SUMMARY OF THE INVENTION

In the view of the foregoing disadvantages inherent in the known types of fall preventing devices now present in the prior art, the present invention provides an improved safety harness for stairs. As such, the general purpose of the present invention, which will be described subsequently in greater detail, is to provide a new and improved safety harness for stairs and method which has all the advantages of the prior art and none of the disadvantages.

To attain this, the present invention essentially comprises a safety belt having a first end portion adapted for adjustable coupling with a torso of a wearer. A second end portion of the safety belt is retractably coupled to a ceiling area at a top of a flight of stairs. An intermediate portion of the safety belt is secured to a wall area adjacent to the flight of stairs. A retracting mechanism is provided. The retracting mechanism is comprised of a housing secured to the ceiling area at the top of the flight of stairs. The housing has an opening in a lower end thereof for receiving the safety belt therethrough. The retracting mechanism includes a belt shaft extending from an interior surface thereof. The belt shaft wrappedly receives the safety belt thereon. A clock spring is disposed on a forward end of the belt shaft. The clock spring biases the belt shaft whereby the safety belt is wrapped around the belt shaft. A ratchet is disposed on the belt shaft inwardly of a rearward end thereof. A pawl is secured within the housing disposed below the ratchet for selectively engaging the ratchet to preclude rotation of the belt shaft. A centrifugal clutch is disposed on the rearward end of the belt shaft. The centrifugal clutch is coupled with the pawl for engaging the pawl with the ratchet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety harness for stairs which has all the advantages of the prior art fall preventing devices and none of the disadvantages.

It is another object of the present invention to provide a new and improved safety harness for stairs which may be easily and efficiently manufactured and marketed.

It is a further object of the present invention to provide a new and improved safety harness for stairs which is of durable and reliable construction.

An even further object of the present invention is to provide a new and improved safety harness for stairs which is susceptible of a low cost of manufacture with regard to both materials and labor, and which accordingly is then susceptible of low prices of sale to the consuming public, thereby making such a safety harness for stairs economically available to the buying public.

Even still another object of the present invention is to provide a new and improved safety harness for stairs for preventing a person from falling down a flight of stairs.

Lastly, it is an object of the present invention to provide a new and improved safety harness for stairs including a safety belt having a first end portion adapted for adjustable coupling with a torso of a wearer. A second end portion of the safety belt is retractably coupled to a ceiling area at a top of a flight of stairs. An intermediate portion of the safety belt is secured to a wall area adjacent to the flight of stairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular, to FIGS. 1 through 6 thereof, the preferred embodiment of the new and improved safety harness for stairs embodying the principles and concepts of the present invention and generally designated by the reference number 10 will be described.

Specifically, it will be noted in the various Figures that the device relates to a safety harness for stairs for preventing a person from falling down a flight of stairs. In its broadest context, the device consists of a safety belt and a retracting mechanism Such components are individually configured and correlated with respect to each other so as to attain the desired objective.

Figure 1:
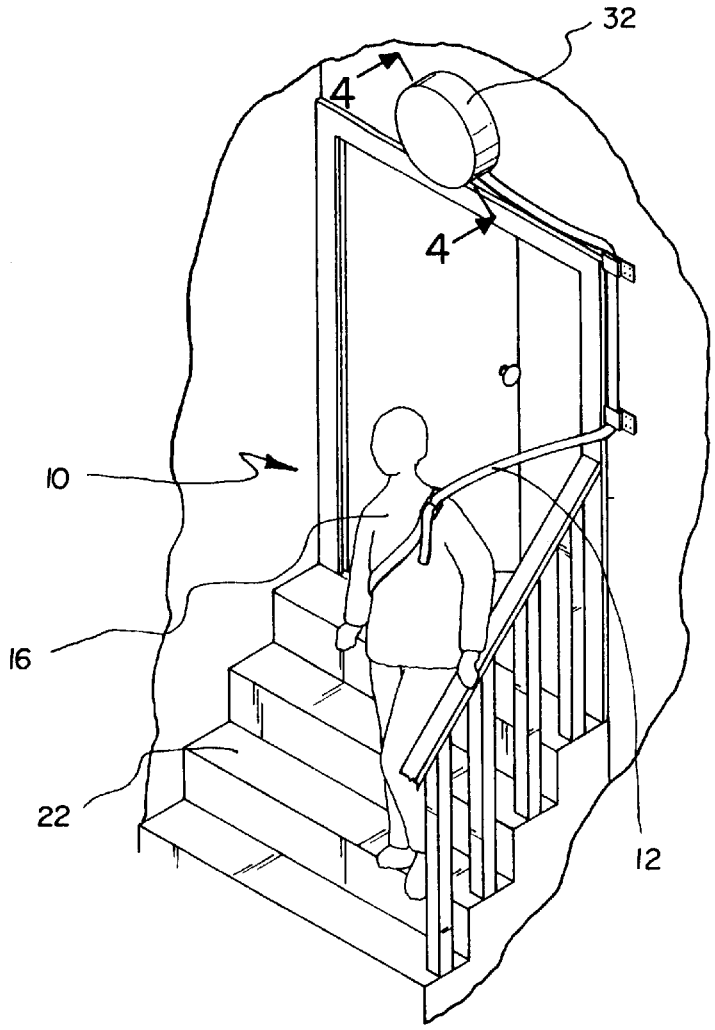
FIG. 1 is a perspective view of the preferred embodiment of the safety harness for stairs constructed in accordance with the principles of the present invention.
Figure 2:
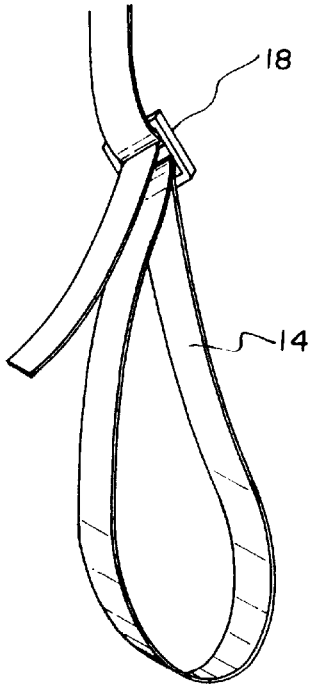
FIG. 2 is a perspective view of the safety belt of the present invention.
Figure 3:
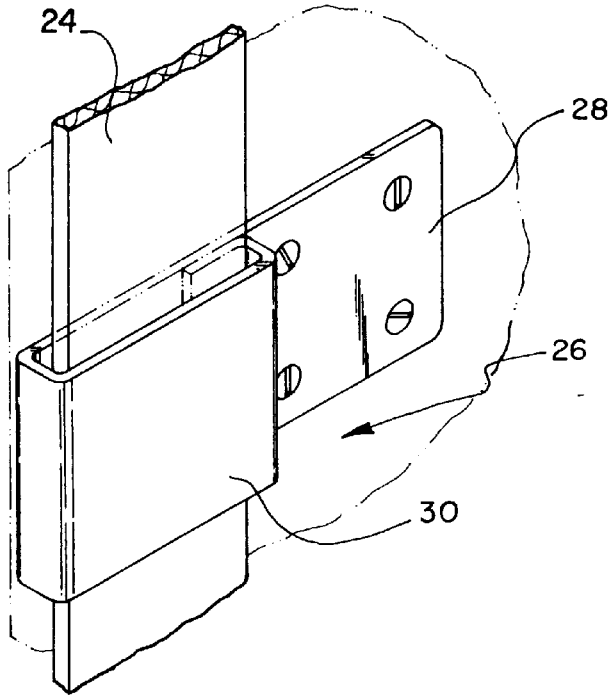
FIG. 3 is a perspective view of the safety belt securement brackets of the present invention.
Figure 4:
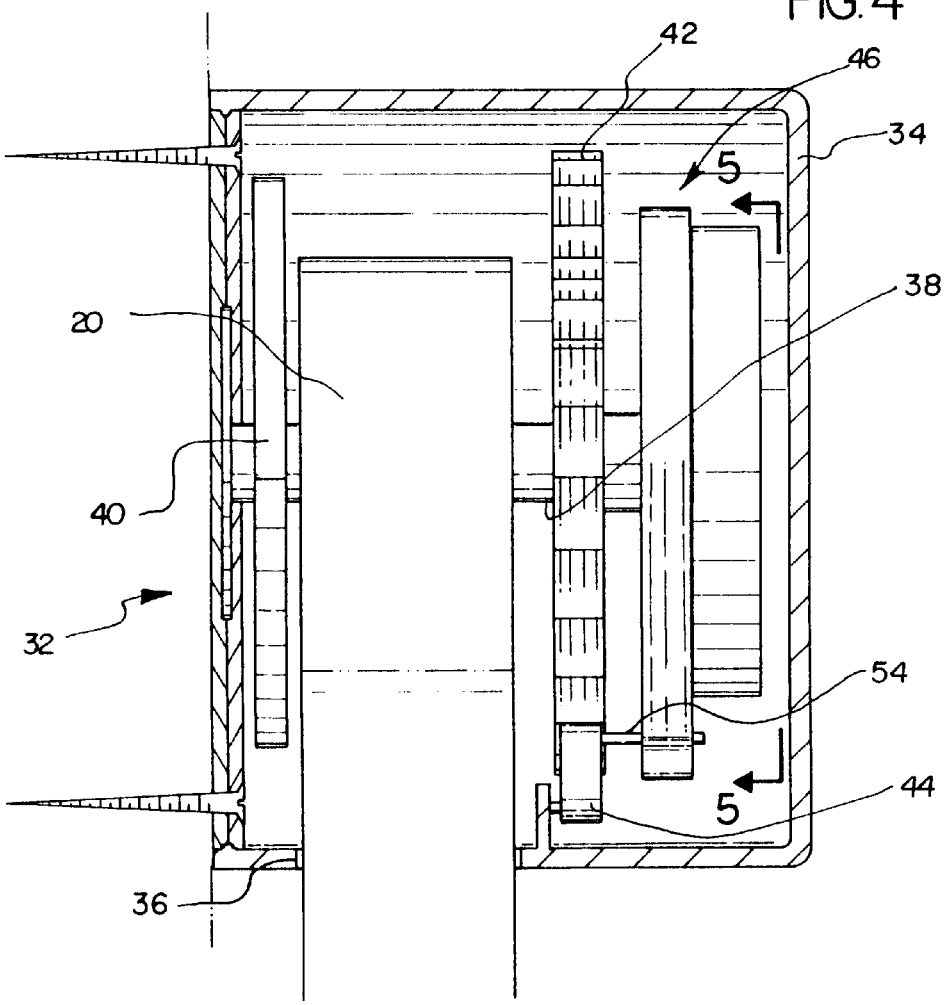
FIG. 4 is a cross-sectional view as taken along line 4—4 of FIG. 1.
Figure 5:
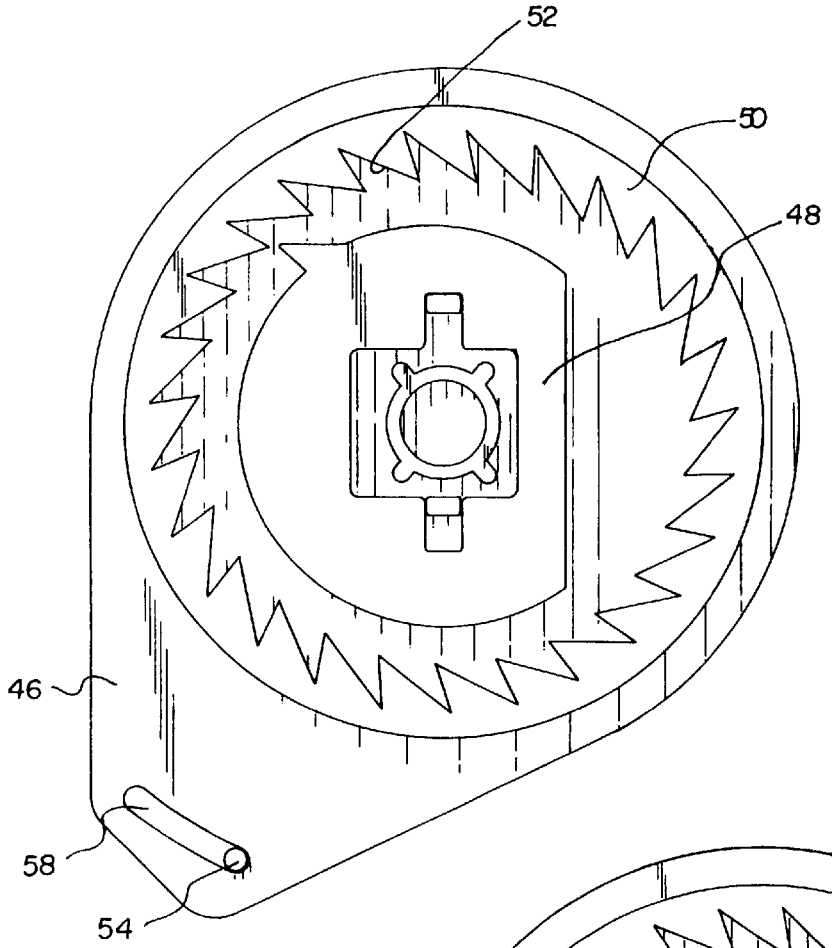
FIG. 5 is a cross-sectional view as taken along line 5—5 of FIG. 4.
Figure 6:
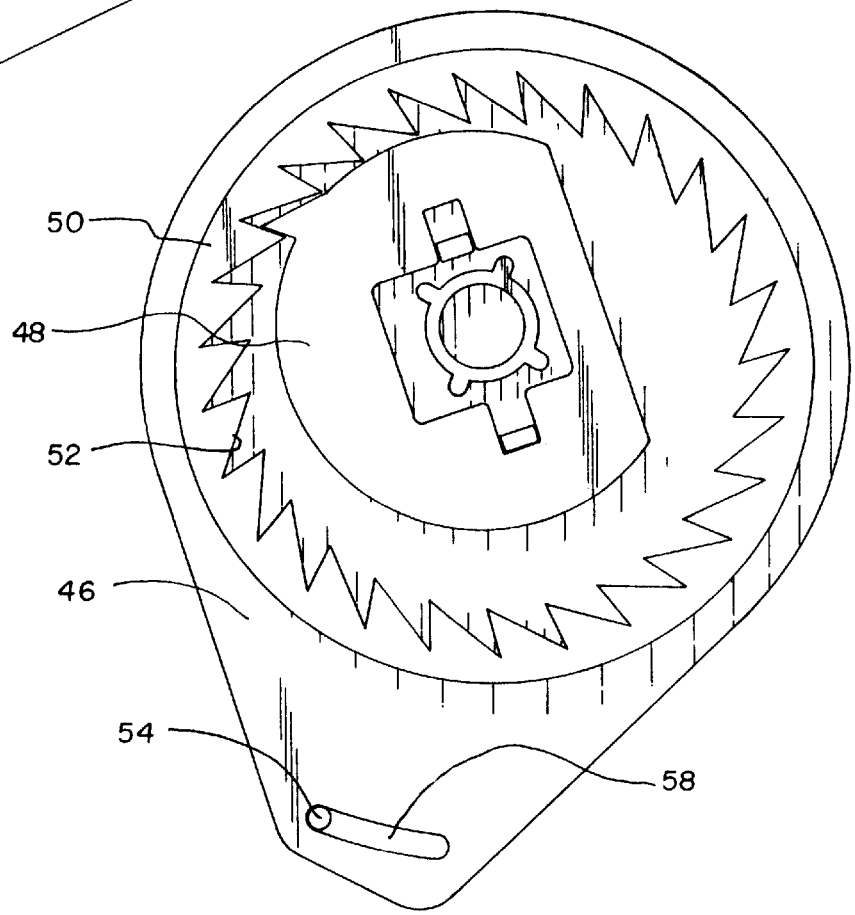
FIG. 6 is a cross-sectional view of the safety belt housing of the present invention in an engaged orientation The same reference numerals refer to the same parts through the various figures.

The device 10 includes a safety belt 12 having a first end portion 14 adapted for adjustable coupling with a torso 16 of a wearer. The first end portion is provided with a buckle 18. The buckle allows the safety belt to be adjusted to properly fit each individual user of the device. Note FIG. 1 A second end portion 20 of the safety belt is retractably coupled to a ceiling area at a top of a flight of stairs 22. An intermediate portion 24 of the safety belt is secured to a wall area adjacent to the flight of stairs. In the preferred embodiment as illustrated in FIG. 1, the device is shown in use on stairs descending from a doorway. The intermediate portion is secured to the wall around the doorway by brackets 26. The brackets, as illustrated in FIG. 3, each include a planar member 28 secured to the wall and a receiving portion 30. The receiving portions slidably receive the safety belt therethrough.

A retracting mechanism 32 is provided. The retracting mechanism is comprised of a housing 34 secured to the ceiling area at the top of the flight of stairs. FIG. 1 illustrates the housing secured over the doorway. The housing has an opening 36 in a lower end thereof for receiving the safety belt therethrough. The opening allows the safety belt to freely slide in and out of the housing. The retracting mechanism includes a belt shaft 38 extending from an interior surface thereof. The belt shaft wrappedly receives the safety belt thereon. A clock spring 40 is disposed on a forward end of the belt shaft. The clock spring biases the belt shaft whereby the safety belt is wrapped around the belt shaft. A small tug of the safety belt, when not is use, will cause the clock spring to rotate the belt shaft thereby wrapping the safety belt around the belt shaft. A ratchet 42 is disposed on the belt shaft inwardly of a rearward end thereof. A pawl 44 is secured within the housing disposed below the ratchet for selectively engaging the ratchet to preclude rotation of the belt shaft. A centrifugal clutch 46 is disposed on the rearward end of the belt shaft. The centrifugal clutch is coupled with the pawl for engaging the pawl with the ratchet. During normal use, a toothed plate 48 of the clutch is not in contact with the clutch and a clutch plate 50 and the belt shaft are free to rotate slowly. A sudden movement makes the toothed plate rotate quickly within the clutch. Centrifugal force makes the toothed plate slide outwardly to engage inner teeth 52 of the clutch. Once the clutch has engaged, it rotates to move the pawl which in turn engages the ratchet. The clutch is connected to the pawl by a pawl shaft 54. The pawl shaft slides within a slot 58 in the clutch. The pawl is fixed to the housing, while the ratchet is attached to the belt shaft. The pawl prevents the ratchet from turning thereby locking the safety belt. When the belt slackens, the clock spring returns the parts to their initial positions and free the safety belt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by letters patent of the united states is as follows:

1. A safety harness system for stairs for preventing a person from falling down a flight of stairs comprising, in combination:

a safety belt having a first end portion adapted for adjustable coupling with a torso of a wearer, a second end portion of the safety belt retractably coupled to a wall area at a top of a flight of stairs, an intermediate portion of the safety belt secured to a wall area adjacent to the flight of stairs; and a retracting mechanism comprised of a housing secured to the wall area at the top of the flight of stairs, the housing having an opening in a lower end thereof for receiving the safety belt therethrough, the retracting mechanism including a belt shaft extending from an interior surface thereof, the belt shaft wrappedly receiving the safety belt thereon, a clock spring disposed on a forward end of the belt shaft, the clock spring biases the belt shaft whereby the safety belt is wrapped around the belt shaft, a ratchet disposed on the belt shaft inwardly of a rearward end thereof, a pawl secured within the housing disposed below the ratchet for selectively engaging the ratchet to preclude rotation of the belt shaft, a centrifugal clutch disposed on the rearward end of the belt shaft, the centrifugal clutch coupled with the pawl for engaging the pawl with the ratchet.

* * * * *